US008795585B2

(12) United States Patent
Majumdar et al.

(10) Patent No.: US 8,795,585 B2
(45) **Date of Patent: *Aug. 5, 2014**

(54) NANOPHASE CRYOGENIC-MILLED COPPER ALLOYS AND PROCESS

(75) Inventors: Barun Majumdar, Redmond, WA (US); James D. Cotton, Issaquah, WA (US); Clifford C. Bampton, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 31 days.

This patent is subject to a terminal disclaimer.

(21) Appl. No.: 11/614,957

(22) Filed: Dec. 21, 2006

(65) Prior Publication Data

US 2010/0278679 A1 Nov. 4, 2010

Related U.S. Application Data

(63) Continuation-in-part of application No. 11/567,121, filed on Dec. 5, 2006.

(51) Int. Cl.
*B22F 1/00* (2006.01)
*B22F 9/04* (2006.01)

(52) U.S. Cl.
CPC ..... *B22F 9/04* (2013.01)
USPC ..... 419/32; 419/31; 419/13; 419/48; 420/469; 420/489; 420/492

(58) Field of Classification Search
CPC ..... B22F 9/04
USPC ..... 419/31, 32; 75/246
See application file for complete search history.

(56) References Cited

U.S. PATENT DOCUMENTS

| | | | | |
|---|---|---|---|---|
| 4,619,699 | A * | 10/1986 | Petkovic-Luton et al. | 75/252 |
| 4,761,263 | A * | 8/1988 | Politis et al. | 419/33 |
| 2004/0177723 | A1* | 9/2004 | Van Daam et al. | 75/354 |
| 2005/0092400 | A1* | 5/2005 | Botcharova et al. | 148/432 |
| 2006/0153728 | A1* | 7/2006 | Schoenung et al. | 419/32 |
| 2008/0131307 | A1 | 6/2008 | Bampton et al. | |

FOREIGN PATENT DOCUMENTS

| | | | |
|---|---|---|---|
| CN | 1616166 | A * | 5/2005 |
| JP | 05311287 | A * | 11/1993 |

OTHER PUBLICATIONS

Benghalem, et al., "Microstructure and mechanical properties of concentrated copper-niobium alloys prepared by mechanical alloying," Materials Science and Engineering A 161 (1993) 255-266.*

K Chittineni and D Bhat, "X-ray Diffraction Investigation of the Formation of Nanostructured Metastable Phases During Short-Duration Mechanical Alloying of Cu—Al Powder Mixtures," Materials & Manufacturing Processes; Sep. 2006, vol. 21 Issue 5, pp. 527-533.*

United States Patent and Trademark Office, "Final Office Action," issued in connection with U.S. Appl. No. 11/567,121, mailed Oct. 31, 2011, 43 pages.

United States Patent and Trademark Office, "Non-Final Office Action," issued in connection with U.S. Appl. No. 11/567,121, mailed May 16, 2011, 41 pages.

United States Patent and Trademark Office, "Advisory Action," issued in connection with U.S. Appl. No. 11/567,121, mailed Apr. 5, 2011, 4 pages.

United States Patent and Trademark Office, "Final Office Action," issued in connection with U.S. Appl. No. 11/567,121, mailed Dec. 27, 2010, 46 pages.

United States Patent and Trademark Office, "Non-Final Office Action," issued in connection with U.S. Appl. No. 11/567,121, mailed Jun. 10, 2010, 29 pages.

United States Patent and Trademark Office, "Advisory Action," issued in connection with U.S. Appl. No. 11/567,121, mailed Jan. 27, 2010, 3 pages.

United States Patent and Trademark Office, "Final Office Action," issued in connection with U.S. Appl. No. 11/567,121, mailed Oct. 29, 2009, 37 pages.

United States Patent and Trademark Office, "Non-Final Office Action," issued in connection with U.S. Appl. No. 11/567,121, mailed Mar. 5, 2009, 42 pages.

United States Patent and Trademark Office, "Restriction Requirement," issued in connection with U.S. Appl. No. 11/567,121, mailed Oct. 29, 2008, 9 pages.

United States Patent and Trademark Office, "Non-Final Office Action," issued in connection with U.S. Appl. No. 11/567,121, mailed Jun. 25, 2012, 41 pages.

United States Patent and Trademark Office, "Final Office Action," issued in connection with U.S. Appl. No. 11/567,121, mailed Mar. 14, 2013, 29 pages.

* cited by examiner

*Primary Examiner* — Roy King
*Assistant Examiner* — Christopher Kessler
(74) *Attorney, Agent, or Firm* — Hanley, Flight & Zimmerman, LLC.

(57) ABSTRACT

There is provided cryogenic milled nanophase copper alloys and methods of making the alloys. The alloys are fine grained having grains in the size range from about 2 to about 100 nanometers, and greater. The nanophase alloys possess desirable physical properties stemming from the fine grain size, such as potentially high strength. Some embodiments of the cryogenic milled copper alloys may also be tailored for ductility, toughness, fracture resistance, corrosion resistance, fatigue resistance and other physical properties by balancing the alloy composition. In addition, embodiments of the alloys generally do not require extensive or expensive post-cryogenic milling processing.

23 Claims, 10 Drawing Sheets

NANOPHASE CRYOGENIC-MILLED COPPER ALLOYS AND PROCESS

CROSS-REFERENCES TO RELATED APPLICATIONS

This is a continuation-in-part pursuant to 35 USC 120 of U.S. application Ser. No. 11/567,121, filed Dec. 5, 2006.

TECHNICAL FIELD

Embodiments relate generally to metal alloys. More particularly, embodiments relate to copper alloys produced by cryogenic-milling.

BACKGROUND

Solid materials synthesized from particles having a grain size in the nanometer range are the subject of active development due to their unique properties. For example, nanometer-scale crystals have the potential of improving the processing and performance characteristics of ceramics, composite polymers, and inter-metallic materials, along with systems, and media incorporating such materials. Products and materials with nanometer-scale crystallites are formed from nanometer-scale particles in processes that entail the steps of forming the particles of the desired chemistry and size scale, combining the particles, and then densifying the particles. Traditional metallurgical techniques such as casting, hot rolling, isostatic pressing, and powder metallurgy have been used to combine the particles.

In the case of aluminum, high strength alloys may be created by cryogenic milling and consolidating aluminum particles. The aluminum particles are then mechanically alloyed using a cryogenic milling operation involving liquid nitrogen in a high-energy ball mill. The powder can subsequently be canned, degassed, and subjected to hot isostatic pressing ["HIP"] to form a fully dense billet. The billet ductility at cryogenic temperatures ranges from about 1% to about 5%. Tensile testing and metallurgical evaluation are routinely carried out as methods for tracking the effectiveness of these processes. Accordingly, cryogenic milling is a technique that might be increasingly important to produce alloys of certain metals that are amenable to this type of processing and that have special or custom properties.

There is an industrial need for high strength copper alloys for certain applications, and this need is often fulfilled with use of a copper-beryllium alloy. While this alloy is useful, some concern has been expressed that beryllium may be a health hazard. Specifically, it is theorized that beryllium at the surface of the alloy may form an oxide that could become airborne. When airborne, the beryllium oxide could be a health hazard to at least some people who are exposed to breathing the oxide. As a consequence, there is a need to develop a high strength copper alloy with a metal other than beryllium that does not raise concerns. In addition, it is desirable that the alloy include those desirable physical properties such as strength that have made copper-beryllium desirable, and if possible provide benefits or advantages that were not present in copper-beryllium. For example, it would be advantageous if the ductility, toughness, fracture resistance, corrosion resistance, fatigue resistance and other physical properties of the alloy could be tailored by balancing the alloy composition. In addition, the alloy should not require extensive or expensive post-treatment. Furthermore, other desirable features and characteristics of the embodiments will become apparent from the subsequent detailed description and the appended claims, taken in conjunction with the accompanying drawings and the foregoing technical field and background.

BRIEF SUMMARY

Embodiments provide cryogenic milled copper alloys and methods of making the alloys. The alloys are fine-grained, with grains in the nano size range, and possess desirable physical properties stemming from the fine grain size. The nano-scale grains are deformed. The copper alloys do not contain beryllium and therefore do not raise the concerns associated with copper-beryllium alloys. In addition, copper alloys may include those desirable physical properties, such as strength, that have made copper-beryllium desirable as a high strength copper alloy. Some embodiments of the cryogenic milled copper alloys may also be tailored for ductility, toughness, fracture resistance, corrosion resistance, fatigue resistance and other physical properties by balancing the alloy composition. In addition, embodiments of the alloys generally do not require extensive or expensive post-cryogenic milling processing.

BRIEF DESCRIPTION OF THE DRAWINGS

A more complete understanding of the exemplary embodiments may be derived by referring to the detailed description and claims when considered in conjunction with the following figures, wherein like reference numbers refer to similar elements throughout the figures.

DETAILED DESCRIPTION

Figure 1:
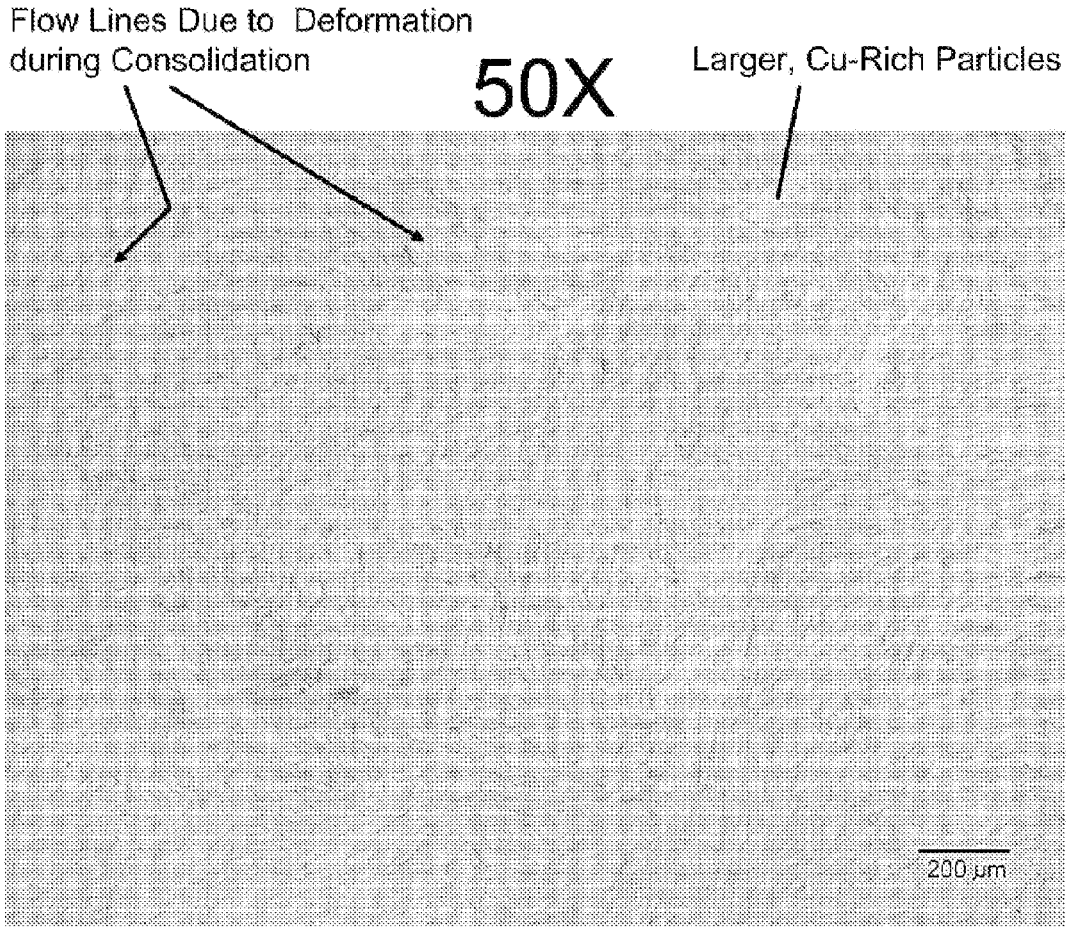
FIG. 1 is a photomicrograph at 50× magnification of an embodiment of a copper alloy.

The following detailed description is merely illustrative in nature and is not intended to limit the embodiments or their application and uses. Furthermore, there is no intention to be bound by any expressed or implied theory presented in the preceding technical field, background, brief summary or the following detailed description.

Attempts have been made in the past to develop a high strength copper alloy suitable to replace copper-beryllium, and perhaps also suitable for other applications where copper-beryllium may not have been commonly used. In general, a "high strength alloy of copper" has strength ranging upwards from around 90 ksi up to about 110 ksi, and further up to about 140 ksi. Useful copper alloys may, however, have strength of about 100 ksi or less depending upon the applications for which they are intended. Some of the attempts in the past to develop a substitute for copper-beryllium have included the use of cryogenic milling of copper powder in liquid nitrogen (also known as "cryo-milling"). It was found that cryogenic milling of copper powder resulted in the formation of agglomerates that upon consolidation under pressure into billets did not provide the strength properties sought. In general, the post-milling consolidation processes resulted in grain growth and produced a product not substantially unlike copper made from other processes. There were no gains in copper strength because of the growth in grain size.

It is theorized, without being bound, that in the past, during cryogenic milling the copper particles were "laminated" and then agglomerated. Under this non-binding theory, the milling first flattened the copper particles into small wafers under impact. Under further milling impacts, these wafers were then folded over upon themselves and re-flattened to continue the lamination process. The repeated cycle of folding over and flattening formed the final laminated particles that may be present as agglomerates in the cryogenic milled product. When attempts were made to consolidate the milled product into a billet, the copper grains once again grew in size and no strength gains were obtained.

From the discovery that cryogenic-milled copper essentially reverted to "ordinary" copper in post-cryogenic milling consolidation treatment, it was further theorized, without being bound, that high strength copper might be obtained by alloying it with a metal that might inhibit grain size growth. It is theorized, without being bound, that in cryogenic-milled aluminum alloys, stable aluminum nitride dispersoids in the nano-scale size range may play a role in preventing grain growth. But, because cryogenic-milled copper does not form stable nitrides, it was theorized without being bound that an additive metal that alloyed readily with copper and that formed stable nitrides might be alloyed with copper. This might provide metal nitrides of a type that inhibit grain size growth of a cryogenic milled product comprising copper as its major component. Of course, whether the nitride of the alloying metal would or could have such an effect was purely speculative and based on a theory that might not be entirely correct. The non-binding theory further suggested that the alloying metal nitrides should be dispersed throughout the copper matrix to minimize any copper grain growth. The resultant fine-grained copper alloy would be dispersion strengthened and would be a high strength copper alloy.

In one embodiment a fine-grained copper alloy is produced by cryogenic co-milling of copper in liquid nitrogen with a metal that alloys with copper and that also forms nitride dispersion. The term "co-milling" as used in the specification and claims with regard to cryogenic milling, means that the metals are comingled in the mill, and are concurrently subjected to milling to cause intimate contact between metal particles being milled. The nitride dispersion in this embodiment is also stable under post-cryogenic milling processing conditions. Furthermore, it is stable under conditions the alloy would ordinarily encounter in useful application in industry or elsewhere. The copper alloy obtained after post cryogenic-milling consolidation is fine grained and embodiments thereof have high strength. A typical post-cryogenic milling consolidation treatment may include subjecting the co-cryogenic-milled powder mass to degassing followed by consolidation into billets via processes such as Ceracon forging or hot isostic pressing.

Aluminum is one of the metals that alloys with copper and that forms a stable nitride. It is soluble in copper up to about 9 wt. % (equilibrium solubility) and it is readily available and presently fairly inexpensive compared to copper. Accordingly, it is a suitable and useful alloying component, but not the only one. Other metals that alloy with copper and that form a stable nitride dispersions under cryogenic milling conditions include for example, zirconium, hafnium, titanium, niobium, and the like.

In general, cryogenic milling has the potential to produce alloys with higher specific strengths than conventional alloys. For example, when the technique has been applied to aluminum powder, the cryogenic-milled aluminum product derived its characteristics from (1) a grain size that, in the final consolidated product, ranges from 100-500 nanometers (nm), and (2) also from sub-nanometer sized nitride dispersoids. It is believed that both the ultra-fine grain size and nitride dispersoids contribute to the strength of the aluminum alloy. The nitride dispersoids are also believed to provide excellent thermal stability of the micro-structure, even at temperatures approaching the cryogenic-milled alloy's melting temperature. This thermal stability prevents or inhibits grain growth during hot isostatic pressing of the cryogenic-milled powder for consolidation, and also during subsequent extrusion, forging and rolling operations.

In fine grained alloys generally, to maintain strength properties, the micro-structural features of grain size and dispersoids should be retained when scaling up and processing to semi-finished products (forgings, extrusions, plate, sheet, wire and foil). The cryogenic-milled alloys of aluminum, for example, exhibit attractive balances of engineering properties, including ductility, toughness and corrosion resistance in addition to high strengths and low densities. Some of these properties may also be expected in certain embodiments of the cryogenic-milled fine grain structured copper alloys. As indicated, embodiments of the copper alloys have fine-grained micro-structure and some of the copper alloys have high strength.

In accordance with another embodiment, cryogenic milling to form a copper alloy avoids the need for solution-treat-and-age (STA) treatments, which are usually necessary in making conventional heat treatable, alloys. Because of the lack of STA treatment, issues of alloy section thickness limitations, residual stress, distortion and formability limits often associated with STA treatments are avoided. The cryogenic milling process also provides opportunities to design and produce unique microstructures: incorporating uniform dispersions of soft and hard particles ranging from the nano-scale, to meso-scale, to the submicron grain size.

Cryogenic milling of copper powder refines the average grain size to less than 100 nanometers (nm). As pointed out above, a fundamental difference between aluminum and copper lies in the thermodynamic stability of their respective nitrides: aluminum nitride (AlN) and copper nitride ($Cu_3N$). While AlN is very stable, $Cu_3N$ is very unstable. In an embodiment, an effective solution to this problem is to add aluminum powder (or the powder of another metal that has stable nitrides and that is compatible in solution with copper at desired alloying proportions) in suitable quantity to the copper powder for co-cryogenic milling in liquid nitrogen.

Aluminum is a good alloying element for micro-structured, cryogenic-milled, copper alloys since it has quite high solid solubility in copper (~92 wt. %). According to some embodiments, aluminum may be alloyed with copper in the range from about 3 to about 9 wt. % aluminum and from about 97 wt. % to about 91 wt. % copper.

In an embodiment, a mixture of about 92 wt. % copper and about 8 wt. % aluminum may be co-cryogenic milled to produce fine structure in the micron size range. Without being bound, it is believed that aluminum dispersoids in the nano-size range are present in the cryogenic-milled product and that these prevent subsequent grain size growth of the copper present in the product under consolidation processing conditions.

Embodiments of the copper alloys are fine grained, with grains in the nano-scale range. Grain size may vary, depending on the specific alloy and the processing conditions during manufacture. However, exemplary embodiments referred to herein as "nanophase alloys" may have fine grained areas in the range about 10 to about 60 nm, while less fine grained areas may be in the range from about 2 up to about 100 nm. Accordingly, the nanophase alloys are characterized by a distribution of sizes where some grains are exceedingly fine and as small as about 2 nm, and other grains are larger and may range up to 100 nm, or more. Generally, however, the major proportion of the grain sizes is in the range from about 2 nm up to about 100 nm.

In one embodiment, cryogenic-milled 96Cu-4Al alloy has excellent oxidation resistance, which greatly facilitates powder processing, compared to conventional copper alloys (which have very low oxidation resistance at elevated temperatures in air). In general, for oxidation resistance, a minimum of about 8 wt. % aluminum is required for copper-aluminum alloys made by non-cryogenic milling processes. Of course, less aluminum can be used where corrosion is not an issue. For example, when electricity transmission is important, copper alloys with more than about 4% aluminum have lower electrical and thermal conductivities and lower burn-resistance.

Figure 2:
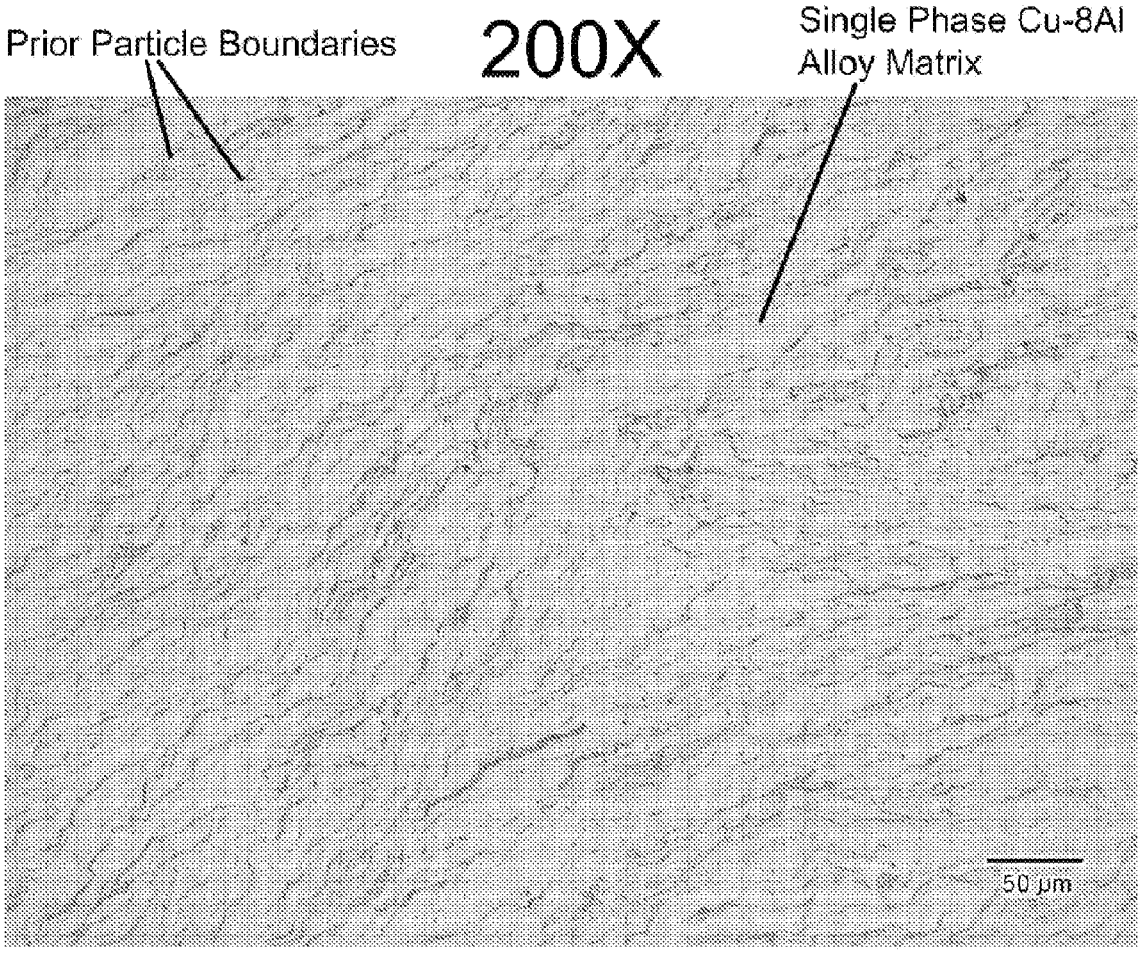
FIG. 2 is a photomicrograph of the alloy of FIG. 1 at 200× magnification.
Figure 3:
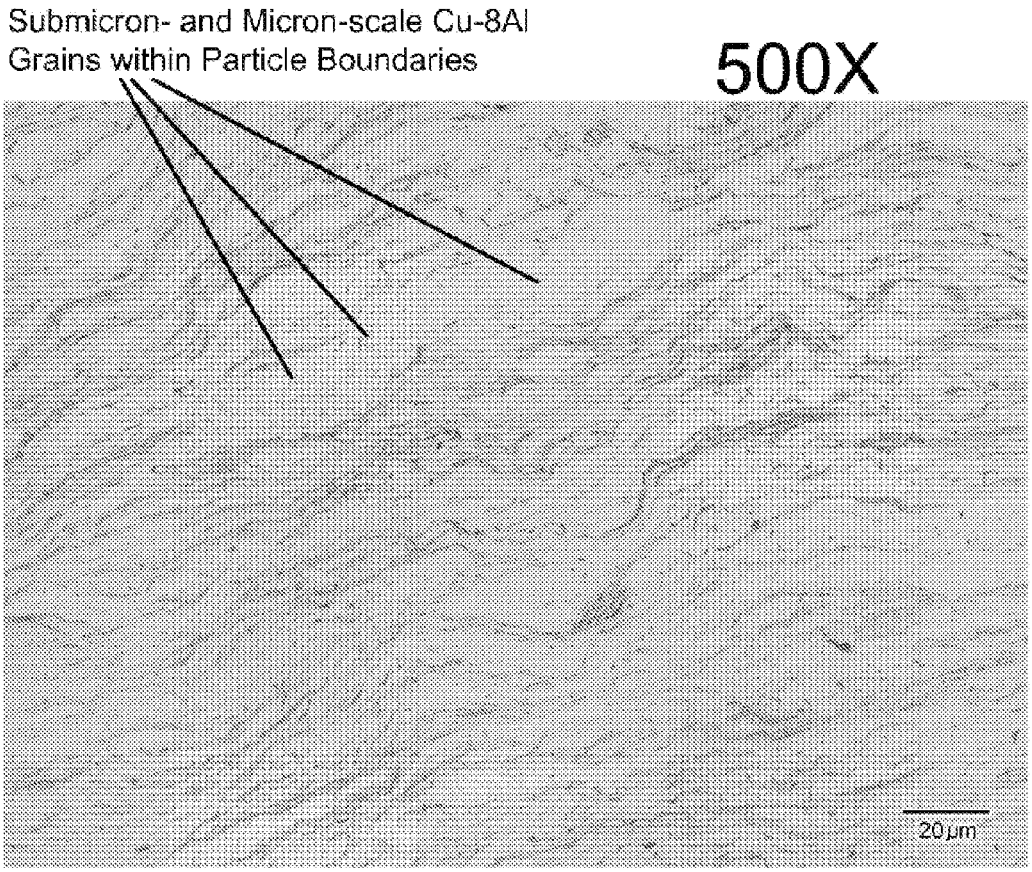
FIG. 3 is a photomicrograph of the alloy of FIG. 1 at 500×.

In another embodiment, billets of 92Cu-8Al exhibit a yellow, bronze-color and have fine grain size as seen under a microscope. For example, a 92Cu-8Al copper-aluminum alloy according to this embodiment is illustrated in FIG. 1, a photomicrograph at 50× magnification. FIG. 1 shows a fine grain structure with some larger copper rich particles pointed out. Further, the photomicrograph also shows some flow lines that resulted from consolidation of the cryogenically milled powder of copper and aluminum. FIG. 2 shows the same alloy Cu-8Al at 200× magnification showing prior particle boundaries and a region of single phase copper-aluminum matrix. FIG. 3 shows the same alloy at 500× magnification. Submicron and micron-scale 92Cu-8Al grains can be seen with particle boundaries.

FIGS. 14-17 are photomicrographs of an exemplary deformed matrix of a copper aluminum alloy. The photomicrographs show nano-sized crystalline grains in a deformed matrix, and were taken using a JEOL 7000 FESEM.

In one embodiment of a method of making the fine-grained copper alloys, the copper powder is co-milled in liquid nitrogen with an alloying metal that is soluble with copper and that forms a stable nitride. The alloying metal nitride is desirably formed as dispersoids of a nano-scale size and dispersed throughout the cryogenic-milled product.

In certain embodiments, the co-cryogenic milling process includes the addition of a quantity of a process control agent. An example of such an agent is stearic acid, although others may also be used, as appropriate. When a hydrocarbon-type process control agent or stearic acid is used, a degassing process on the cryogenic milled product may be necessary before consolidation. The degassing step may be carried out in stages with a first stage at room temperature under high vacuum for a period of time that will vary depending upon the specific process control agent used, the level of vacuum applied, temperature, and other degassing process parameters. Subsequent degassing stages may involve heating the cryogenic milled product and dwelling for a sufficient time at temperature and under high vacuum. When gas evolution has decreased to an insignificant level, the cryogenic milled degassed product is ready for consolidation.

According to some embodiments, consolidation may be carried out using the hot isostatic pressing ("HIP") process or using Ceracon forging to form billets of the copper alloy. In the case of HIP, process conditions may be similar to those employed in Ceracon forging.

Ceracon forging, which may also be used in some embodiments of the process, is typically carried out at about 850° C. and 100 ksi for a dwell time of about 30 minutes. Variations around these temperature, pressure and dwell times are also useful. Clearly, pressure may be reduced and dwell time and/or temperature increased to obtain the same or substantially similar consolidated end product.

After consolidation, the fine-grained billeted copper alloys may be treated by any of the usual processes employed for manufacture of useful products from billets. These products or metal objects may find application in a variety of industries and may include automobile components, aircraft components, and the like. In particular, the copper alloys may be used as a substitute to make any metal object that is currently manufactured from copper-beryllium alloys, or for which copper beryllium might be a suitable choice due to strength requirements and other properties in common with embodiments of the copper alloys provided herein.

The following examples illustrate exemplary embodiments but do not limit the scope and variety of the embodiments as herein claimed and described.

EXAMPLES

Two mill conditioning runs were conducted. These runs each included co-cryogenic milling of 460 g of copper powder and 40 g of aluminum powder for about 8 hours in liquid nitrogen.

Based on findings in the two mill conditioning runs, stearic acid was added as a process control agent. In the first run, when no stearic acid was added, it was found that the milled product showed little mixing of copper and aluminum. The mill produced a non-homogeneous mix of reddish copper powder and silver aluminum flakes. Large formations of aluminum-rich agglomerates were observed as silverfish flakes. The two powders separated upon shaking in a container. Stearic acid was added to the second conditioning run at 2 wt. %. This addition improved the properties of the cryogenic-milled product: the mixture was homogeneous with a reddish color, no large agglomerates were visible, and powder agglomerates formed small flakes and behaved like paint. There was no separation of the metal components upon shaking a sample in a container.

Each of the six subsequent test runs included, as a batch charged to the mill, the following: 920 g copper powder, 80 g aluminum powder, and 2 g of stearic acid as a process control agent. The mill was run at a speed of 180 rpm and chilled with liquid nitrogen.

The milled powder obtained from each run was reddish, copper colored and free of silver flakes and agglomerates. The volume of milled powder appeared large compared to volume charged to the mill. This indicates a lightly packed powder which is common with a flake shape powder particle. The packing density was about 30%, which is very low. Manual application of pressure increased packing density to about 45%.

The powder from each of the six runs was charged to a separate steel can. Each of the six cans measured 4 inches in diameter and 7 inches high for degassing. For each can, the can was welded to form a seal at the top, with an opening to pull a vacuum for de-gassing the powder. During degassing, heat was applied to increase the temperature in the first stage to 120° C. to drive off moisture. This was maintained overnight under high vacuum. Temperature was then ramped up to 400° C. Gas was evolved in quantity. After 12 hours at 400° C., the temperature was raised to 600° C. After 12 hours at 600° C., the vacuum in the can was $4.5\times10^{-6}$ Torr. After a further 8 hours at 600° C., the vacuum was $3.6\times10^{-6}$ Torr and gas evolution, if any, was insignificant. The furnace was stopped.

The degassed products from the six cans were consolidated in their respective cans using the Ceracon procedure. Consolidation was at maximum 100 ksi pressure and maximum 850° C. The dwell time at maximum temperature and pressure was about 20 seconds.

The consolidated billeted material obtained from each of the six cans was a yellowish, bronze-colored metal. This indicates that the copper and aluminum had alloyed. Rockwell B hardness ranged from 93 to 96 indicating a tensile strength of 102 ksi.

Figure 4:
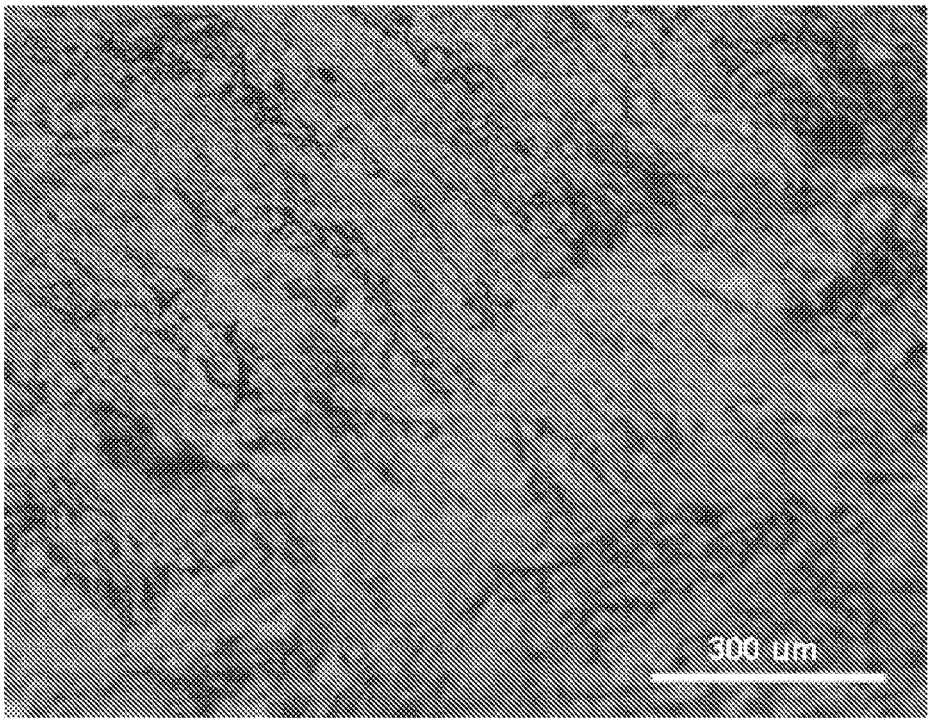
FIGS. 4-7 are photomicrographs at 100× magnification of an embodiment of a copper alloy sample prepared as described in the example here below.
Figure 5:
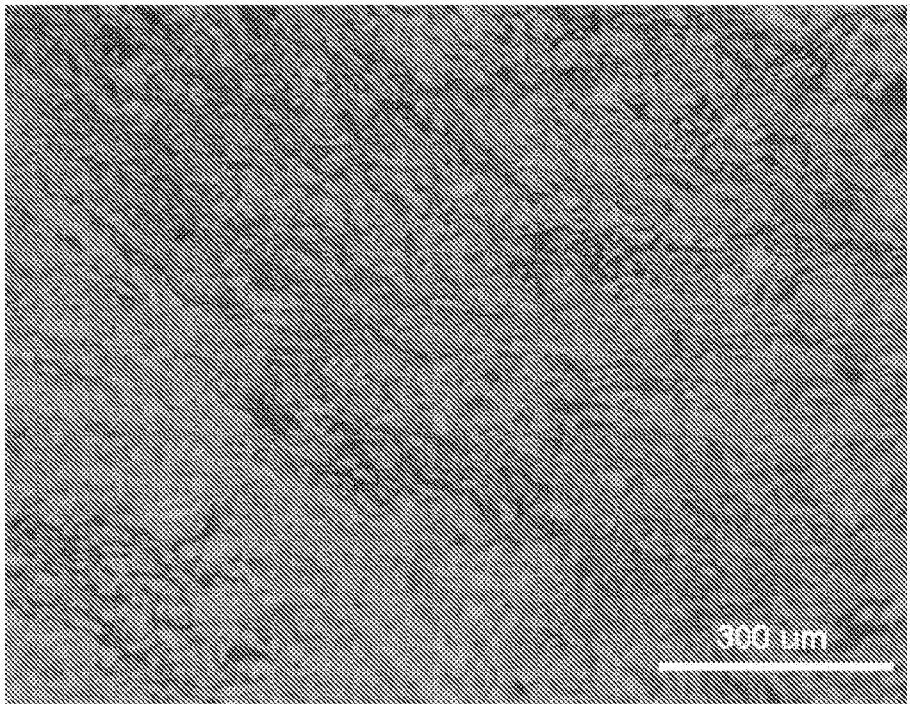
Figure 6:
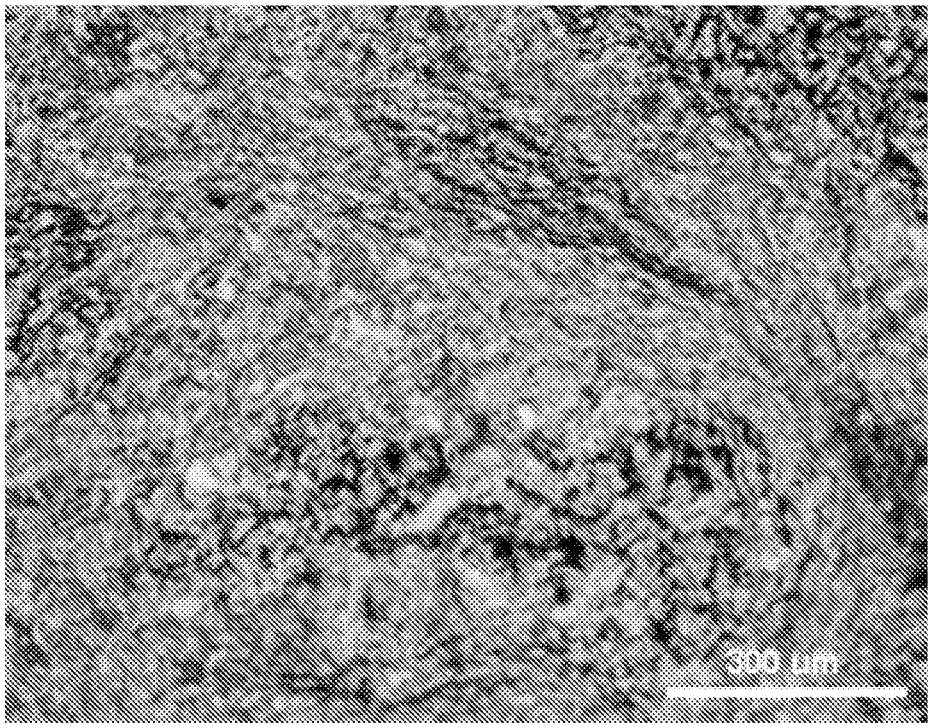

Optical photomicroscopy at 100× magnification [FIGS. 4-6] showed the following: the grain structure was extremely fine and very distorted, no porosity, no indications of incipient melting of the aluminum or aluminum-rich indicating excellent mixing of aluminum into copper or formation of aluminum nitrides, dark bands present could be oxides or a phase richer in aluminum.

Figure 7:
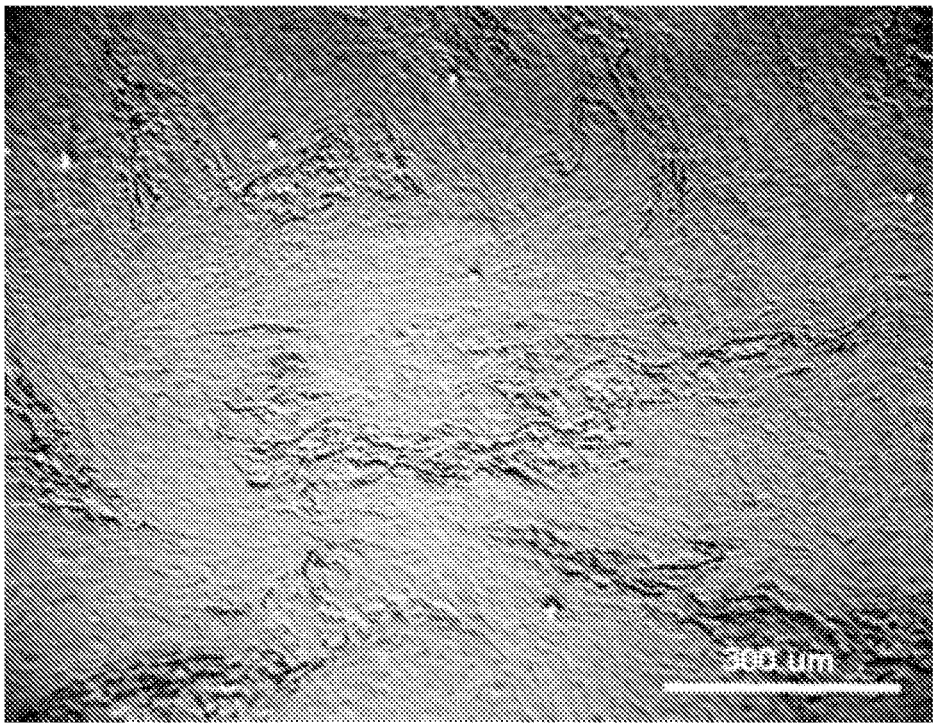
Figure 8:
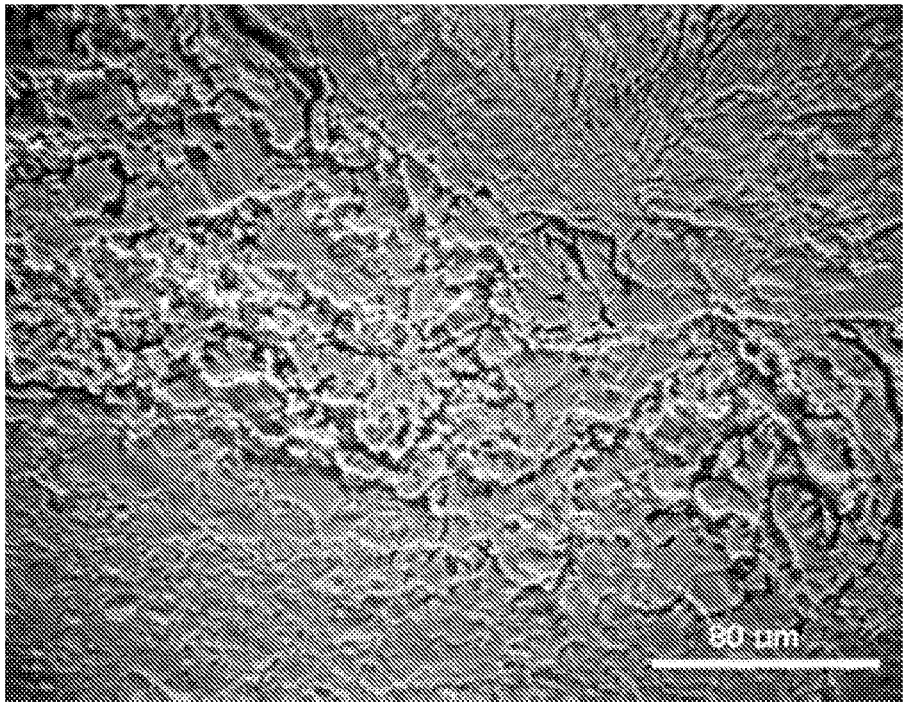
FIGS. 8-12 are scanning electron photomicrographs of an embodiment of a copper alloy sample prepared as described in the example here below.
Figure 9:
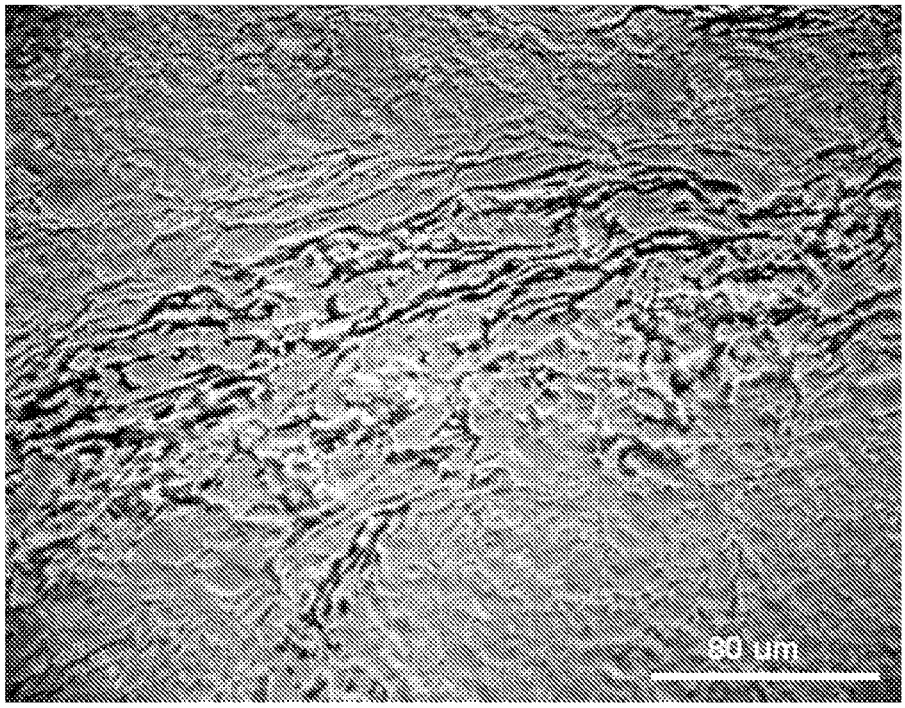
Figure 10:
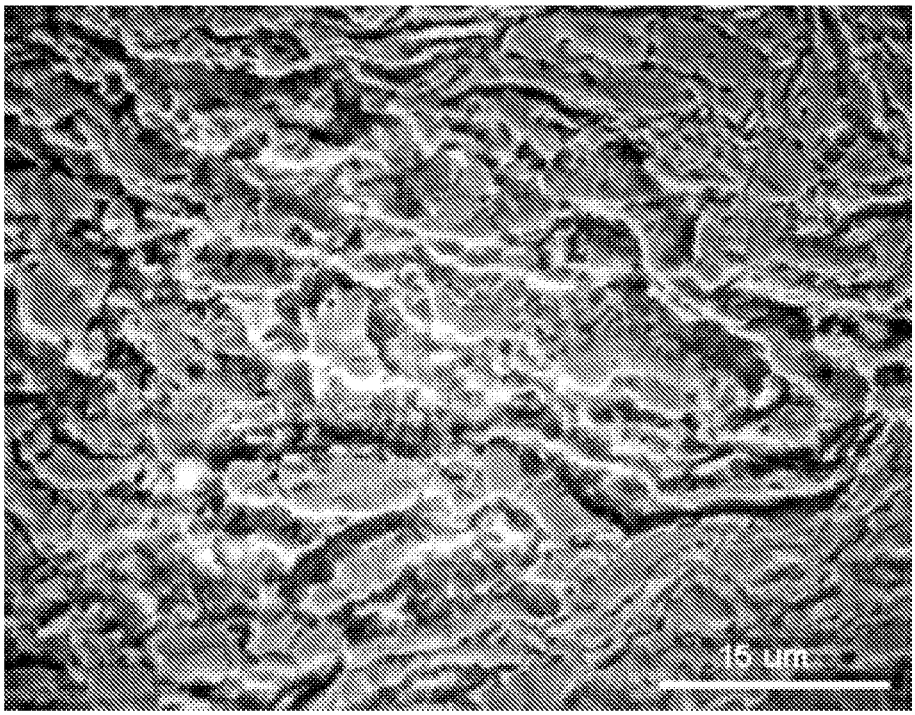
Figure 11:
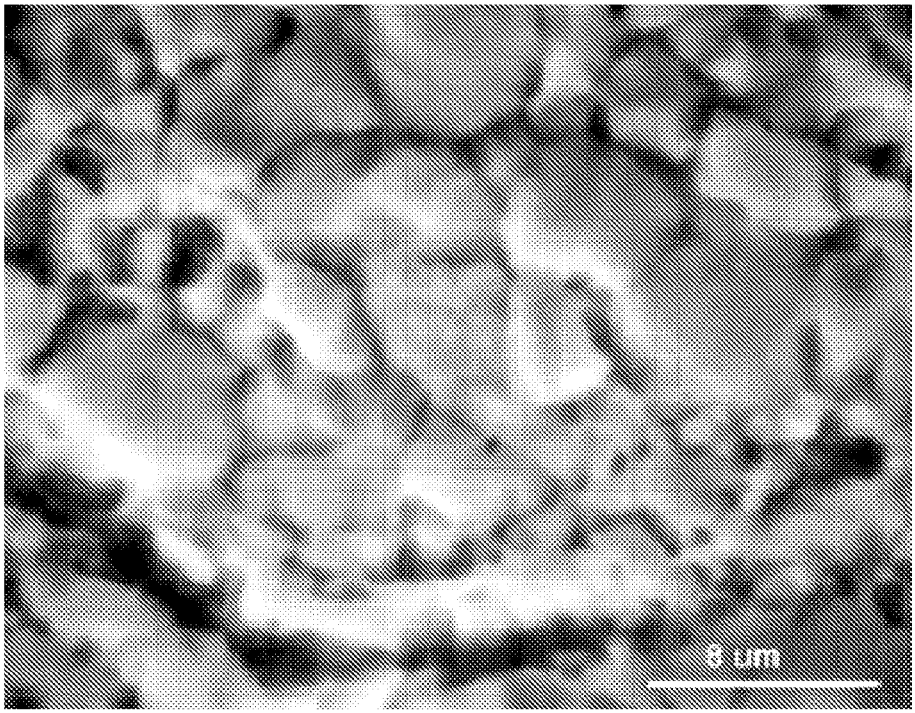
Figure 12:
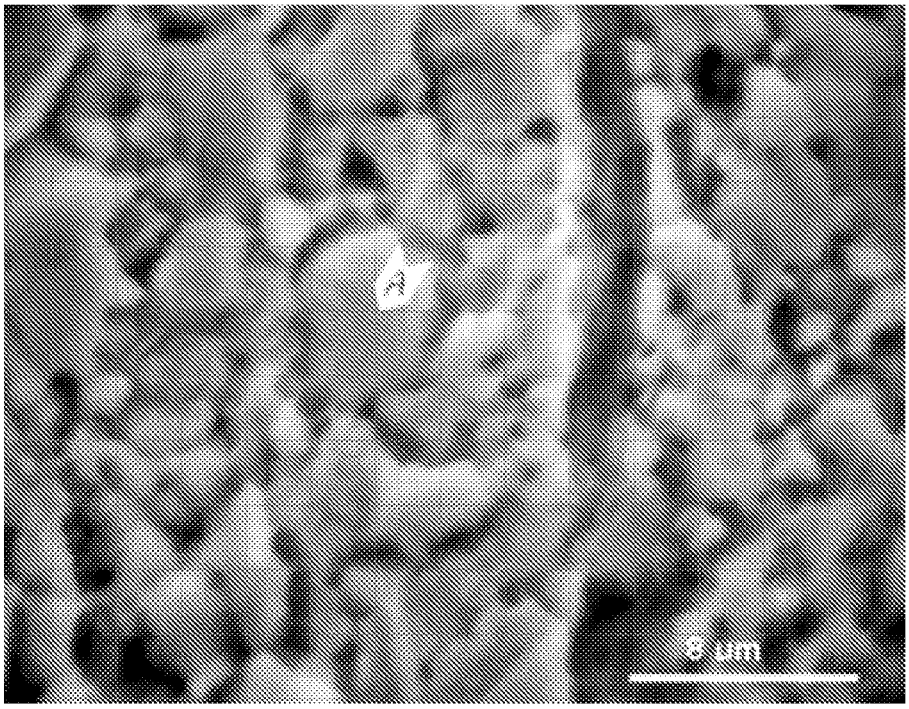
Figure 13:
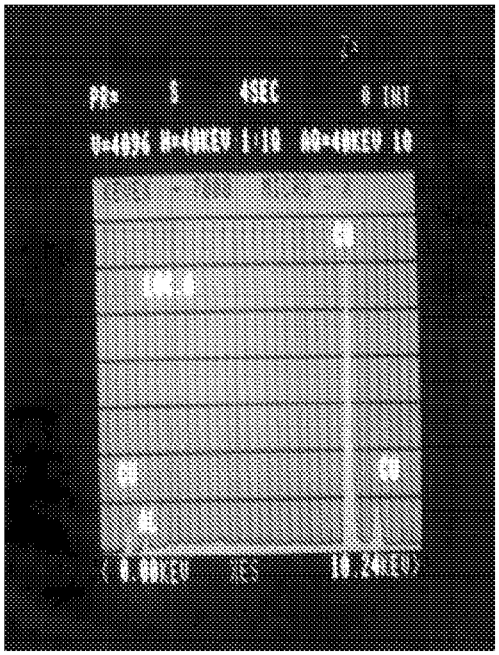
FIG. 13 is an Energy Dispersion Spectroscopy scan of an embodiment of a copper alloy sample prepared as described in the example here below.
Figure 14:
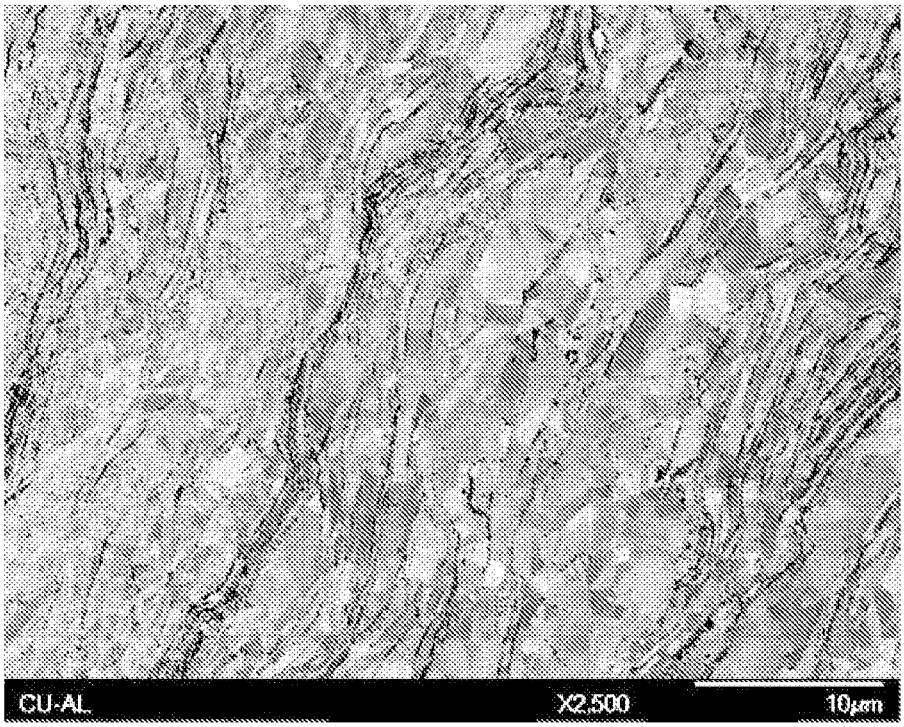
FIGS. 14-17 are photomicrographs at 2500× taken with a Field Emission SEM, model JEOL 7000, made by JEOL of Japan, showing grain structure of an exemplary embodiment of a 92Cu-8Al copper-aluminum alloy.
Figure 15:
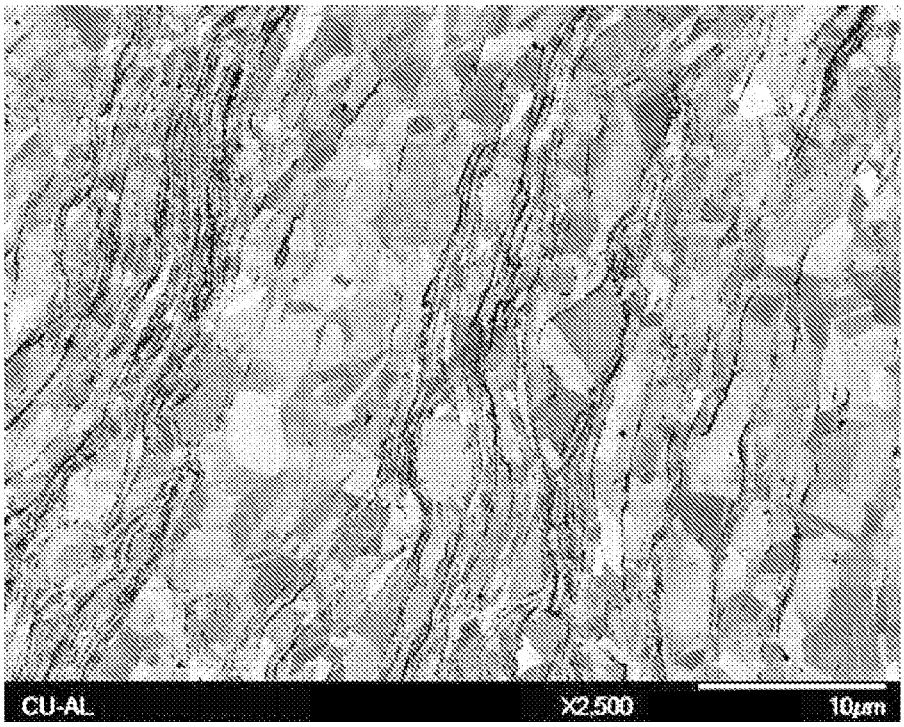
Figure 16:
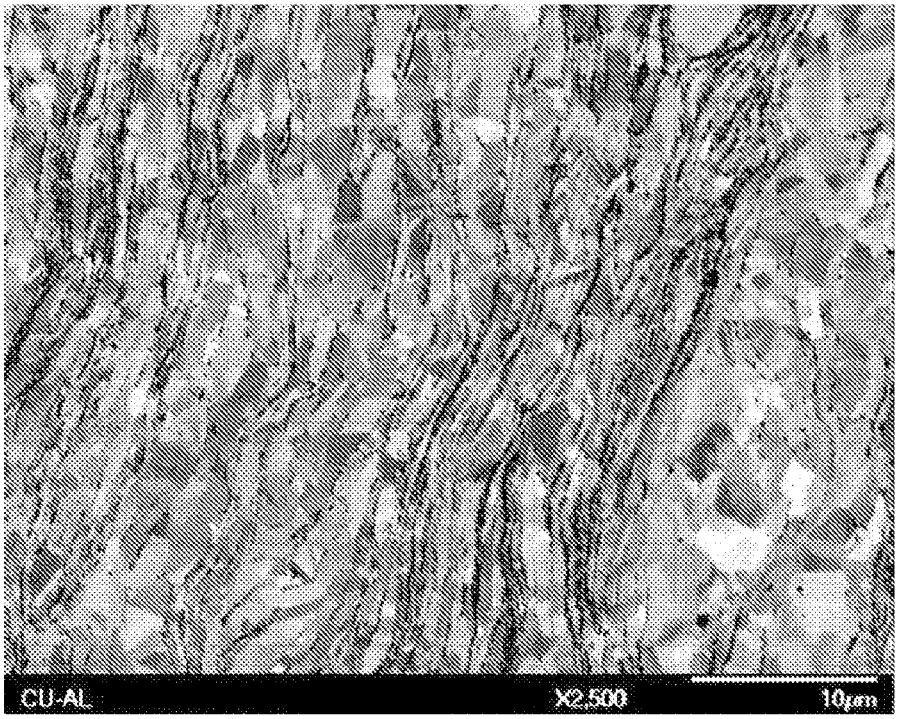
Figure 17:
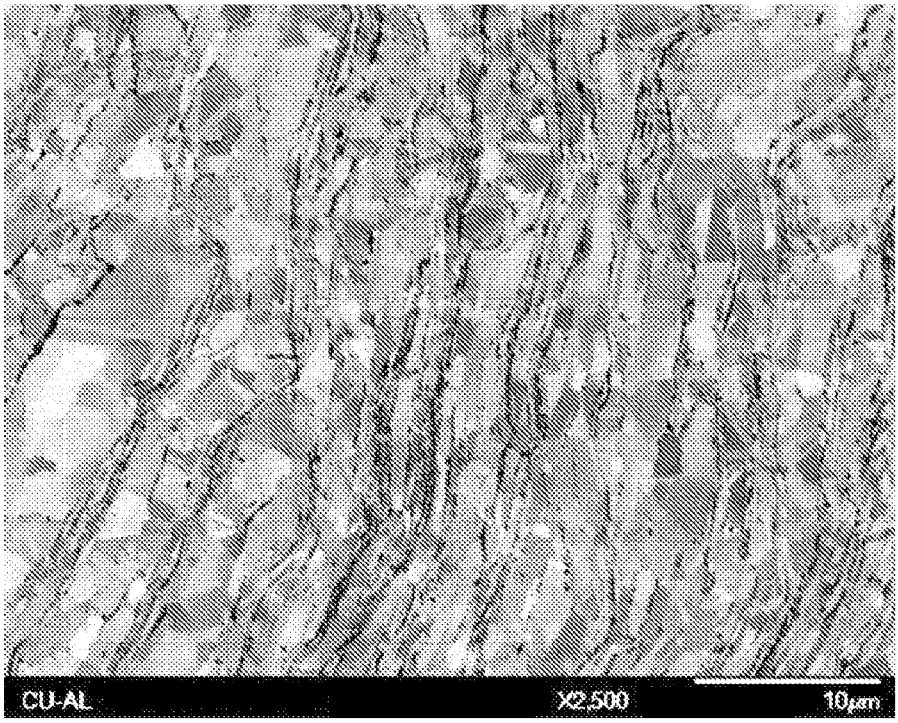

A sample of the product alloy was etched with hydrochloric acid and subjected to scanning electron microscopy. FIG. 7 is at the same magnification (100×) as the photomicrographs to facilitate comparisons. FIGS. 8-9 show that the dark bands were preferentially etched and appear to confirm these are aluminum or aluminum-rich areas, and not $Al_2O_3$. The same holds for FIG. 10. FIGS. 11-12 show the etched structure down to micrometer level and shows fine grained structure. FIG. 13 is an Energy Dispersion Spectroscopy scan showing only Cu and Al peaks. Analysis appears to confirm a 92Cu-8Al composition of the sample. FIGS. 14-17 are photomicrographs at 2500× taken with a Field Emission SEM, model JEOL 7000, made by JEOL of Japan, showing grain structure of an exemplary embodiment of a 92Cu-8Al copper-aluminum alloy. The grain structure confirms a nanophase alloy, as defined above.

While at least one example embodiment has been presented in the foregoing detailed description, it should be appreciated that a large number of variations exist. It should also be appreciated that the example embodiment or embodiments described herein are not intended to limit the scope, applicability, or configuration of the range and variety of embodiments in any way. Rather, the foregoing detailed description will provide those skilled in the art with a convenient road map for implementing the described embodiment or embodiments. It should be understood that various changes can be made in the function and arrangement of elements without departing from the scope of the technology as set forth in the appended claims and the legal equivalents thereof.

What is claimed is:

1. A method for making a high strength nanophase copper alloy comprising:

co-milling in contact with liquid nitrogen a first mass of a copper powder and a second mass of a second metal powder, the second metal powder comprised of a second metal that is soluble in copper and that forms stable nitrides under said co-milling conditions including said contact with liquid nitrogen to form a co-milled mass of powder comprising said nitrides, said first mass of copper powder being from about 91 wt. % to about 97 wt. %, said co-milled mass of powder being free of Be, said stable nitrides formed during said co-milling in the presence of said liquid nitrogen;

degassing said co-milled mass of powder;

subjecting the co-milled mass of powder to heat and pressure; and consolidating the co-milled mass into a billet comprising an alloy of copper comprising the second metal that is soluble in copper, said copper alloy comprising nanophase copper alloy grains.

2. The method of claim 1, wherein the second metal powder is selected from the group of powders of metals consisting of aluminum, zirconium, hafnium, and niobium.

3. The method of claim 1, wherein the second mass of the second metal powder comprises an aluminum powder and co-milling comprises co-milling from about 3 to about 9 wt % of the aluminum powder based on a sum of the first mass of the copper powder and the aluminum powder.

4. The method of claim 1, wherein the second mass of powder of the second metal comprises an aluminum powder and co-milling comprises co-milling about 92 wt. % of the copper powder and about 8 wt. % of the aluminum powder.

5. The method of claim 1, wherein the consolidating produces a nanophase alloy comprising grains in a range from about 2 to about 10 nanometers.

6. The method of claim 5, wherein the consolidating produces a copper alloy having a strength in the range from about 90 to about 110 ksi.

7. The method of claim 5, wherein the consolidating produces a copper alloy having a strength in the range from about 110 to about 140 ksi.

8. The method of claim 1, wherein the consolidating produces a copper alloy comprising nano-scale sized dispersoids of nitrides of the second metal.

9. The method of claim 1, further comprising adding a process control agent and co-milling the process control agent with the copper powder and the second metal powder.

10. The method of claim 1, wherein said nanophase copper alloy comprises an average copper alloy grain size of from about 2 to about 100 nm.

11. A method for making a high strength nanophase copper allow comprising:

co-milling in contact with liquid nitrogen a first mass of a copper powder and a second mass of a second metal powder, the second metal powder comprised of a second metal that is soluble in copper and that forms stable nitrides under said co-milling conditions including said contact with liquid nitrogen to form a co-milled mass of powder comprising said nitrides, said first mass of copper powder being from about 92 to about 96 wt %, said co-milled mass of powder being free of Be, said stable nitrides formed during said co-milling in the presence of said liquid nitrogen;

degassing said co-milled mass of powder;

subjecting the co-milled mass of powder to heat and pressure; and consolidating the co-milled mass into a billet comprising an alloy of copper comprising the second metal that is soluble in copper to produce said nanophase copper alloy, said nanophase copper alloy comprising an average copper alloy grain size of from about 2 to about 100 nm.

12. The method of claim 11, wherein the second metal powder is selected from the group of powders of metals consisting of aluminum, zirconium, hafnium and niobium.

13. The method of claim 11, wherein the second mass of the second metal powder comprises an aluminum powder and the step of co-milling comprises co-milling from about 4 to about 8 wt % of the aluminum powder based on a sum of the first mass of the copper powder and the aluminum powder.

14. The method of claim 11, wherein the second mass of powder of the second metal comprises an aluminum powder and co-milling comprises co-milling about 92 wt. % of the copper powder and about 8 wt. % of the aluminum powder.

15. The method of claim 11, wherein the consolidating produces said nanophase copper alloy comprising grains in a range from about 2 to about 10 nanometers.

16. The method of claim 11, wherein the consolidating produces said nanophase copper alloy having a strength in the range from about 90 to about 100 ksi.

17. The method of claim 11, wherein the consolidating produces said nanophase copper alloy having a strength in the range from about 110 to about 140 ksi.

18. The method of claim 11, wherein the consolidating produces a copper alloy comprising nano-scale sized dispersoids of nitrides of the second metal.

19. The method of claim 11, further comprising adding a process control agent and co-milling the process control agent with the copper powder and the second metal powder.

20. A method for making a copper alloy comprising:

co-milling in contact with liquid nitrogen a first mass of a copper powder and a second mass of a second metal powder that is soluble in copper, the second metal powder to form stable nitrides under co-milling conditions when in contact with liquid nitrogen to form a co-milled mass of powder including the nitrides, the first mass of copper powder being from about 91 wt. % to about 97 wt %, the co-milled mass of powder being free of Be, and the stable nitrides formed during the co-milling in the presence of said liquid nitrogen.

21. The method of claim 20, further comprising degassing said co-milled mass of powder.

22. The method of claim 20, further comprising subjecting the co-milled mass of powder to heat and pressure.

23. The method of claim 20, further comprising consolidating the co-milled mass into a billet comprising an alloy of copper comprising the second metal that is soluble in copper, said copper alloy comprising nanophase copper alloy grains.

* * * * *